US010485356B2

(12) United States Patent
Yang

(10) Patent No.: US 10,485,356 B2
(45) Date of Patent: Nov. 26, 2019

(54) FOLDABLE MATTRASS FOR TRANSPORTATION

(71) Applicant: Lei Yang, City of Industry, CA (US)

(72) Inventor: Lei Yang, City of Industry, CA (US)

(73) Assignee: Furniture of America, Inc., City of Industry, CA (US)

( * ) Notice: Subject to any disclaimer, the term of this patent is extended or adjusted under 35 U.S.C. 154(b) by 333 days.

(21) Appl. No.: 14/826,179

(22) Filed: Aug. 13, 2015

(65) Prior Publication Data

US 2017/0042338 A1 Feb. 16, 2017

(51) Int. Cl.
*A47C 27/08* (2006.01)
*A47C 27/05* (2006.01)

(52) U.S. Cl.
CPC ..... *A47C 27/084* (2013.01); *A47C 27/056* (2013.01); *A47C 27/088* (2013.01)

(58) Field of Classification Search
CPC ... A47C 27/056; A47C 27/081; A47C 27/084; A47C 27/088
See application file for complete search history.

(56) References Cited

U.S. PATENT DOCUMENTS 4,145,781 A * 3/1979 Autrey ..... A47C 27/085 5/679
4,389,743 A * 6/1983 Callaway ..... A47C 27/001 5/720
4,694,515 A * 9/1987 Rogers, Jr. ..... A47C 17/22 137/223
4,879,775 A * 11/1989 Keefer ..... A47C 27/085 5/680
4,965,901 A * 10/1990 Normand ..... A47C 27/128 5/710
4,991,244 A * 2/1991 Walker ..... A47C 27/082 5/400
5,557,813 A * 9/1996 Steed ..... A47C 27/001 5/678
6,085,372 A * 7/2000 James ..... A61G 7/001 5/713
6,446,289 B1 * 9/2002 Su ..... A47C 27/084 5/420
2005/0081299 A1 * 4/2005 Torres ..... A47C 27/10 5/710
2005/0177951 A1 * 8/2005 Guifang ..... A47C 27/087 5/706

(Continued)

*Primary Examiner* — Robert G Santos
*Assistant Examiner* — Rahib T Zaman
(74) *Attorney, Agent, or Firm* — Raymond Y. Chan; David and Raymond Patent Firm

(57) ABSTRACT

A foldable mattress includes a mattress body having a top layer and a bottom layer, a core mattress support disposed between the top and bottom layers within a center portion of the mattress body, an air valve operatively coupled at the mattress body for inflating the mattress body from a folded state to an unfolded state, and a peripheral mattress support disposed at a peripheral portion of the mattress body when the mattress body is in the unfolded state. At the folded state, the mattress body is air-vacuumed that the top layer is overlapped on the bottom layer to compress the core mattress support therebetween to minimize a thickness of the mattress body. At the unfolded state, the mattress body is inflated to uncompress the core mattress support so as to fully expand the mattress body.

17 Claims, 6 Drawing Sheets

(56) References Cited

U.S. PATENT DOCUMENTS

| | | | | |
|---|---|---|---|---|
| 2005/0188465 | A1* | 9/2005 | Fahey | A47C 20/025 5/706 |
| 2005/0204475 | A1* | 9/2005 | Schmitz | A47C 27/10 5/710 |
| 2005/0273939 | A1* | 12/2005 | Mossbeck | A47C 23/047 5/720 |
| 2006/0010606 | A1* | 1/2006 | Harris | A47C 19/022 5/706 |
| 2010/0192299 | A1* | 8/2010 | Schermel | A47C 21/048 5/421 |
| 2010/0235988 | A1* | 9/2010 | Pittman | A47C 17/80 5/119 |
| 2013/0000047 | A1* | 1/2013 | McCann | A47C 27/082 5/709 |
| 2016/0186874 | A1* | 6/2016 | Lin | F16K 15/202 137/232 |

* cited by examiner

FOLDABLE MATTRASS FOR TRANSPORTATION

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a mattress structure, and more particularly to a foldable mattress, which can be folded into a compact unit for storage and transportation.

Description of Related Arts

Mattresses provide a comfortable platform for a sleeper residing thereon. However, they are large and bulky for transportation. Since the mattresses are manufactured in certain standard sizes, such as from a twin size to a king size, they are often too bulky to carry into a room through a small hallway or a door of a building. In addition, it is always a problem for the mattress manufacturers to transport the mattresses from the factory to the warehouse or the retail store, and for the mattress distributors to ship the mattresses from the warehouse or the retail store to the end user.

Accordingly, a mattress generally comprises a top layer, a bottom layer, and a spring support supported between the top and bottom layers to define a center spring supporting area, such that the spring support can only support the center portion of the mattress when the user resides thereon. In other words, there is no support at the peripheral portion of the mattress. Especially when the user sits on the peripheral portion of the mattress, the peripheral portion of the mattress will be collapsed. In order to solve the problem, the mattress further includes a peripheral supporting board supported between the top and bottom layers at the peripheral portion of the mattress. The peripheral supporting board is rigid enough to retain the shape of the mattress. Therefore, it is impossible to fold up the mattress into a compact size.

SUMMARY OF THE PRESENT INVENTION

The invention is advantageous in that it provides a foldable mattress, which can be folded into a compact unit for storage and transportation.

Another advantage of the invention is to a foldable mattress, wherein the mattress body is deflated to minimize the thickness of the mattress body, such that the deflated mattress body can be rolled up and packed in a box for storage and transportation.

Another advantage of the invention is to a foldable mattress, wherein the peripheral mattress support is disposed at the peripheral portion of said mattress body when the mattress body is in the unfolded state, such that the center portion and the peripheral portion of the mattress body are supported by the core mattress support and the peripheral mattress support respectively when the mattress body is in the unfolded state.

Another advantage of the invention is to a foldable mattress, wherein the mattress body is self-inflated until the mattress body is fully expanded. Therefore, the user does not require any tool to set up the foldable mattress from the folded state to the unfolded state.

Another advantage of the invention is to a foldable mattress, which does not require to alter the original structural design of the mattress, so as to minimize the manufacturing cost of the mattress with the foldable features.

Another advantage of the invention is to a foldable mattress, wherein no expensive or complicated structure is required to employ in the present invention in order to achieve the above mentioned objects. Therefore, the present invention successfully provides an economic and efficient solution for providing a rigid configuration for the foldable mattress at the unfolded state and for providing a compact configuration for the foldable mattress at the folded state.

Additional advantages and features of the invention will become apparent from the description which follows, and may be realized by means of the instrumentalities and combinations particular point out in the appended claims.

According to the present invention, the foregoing and other objects and advantages are attained by a foldable mattress which comprises:

a mattress body which comprises a top layer and a bottom layer, and defines a center portion and a peripheral portion;

a core mattress support disposed between the top layer and the bottom layer within the center portion of the mattress body;

an air valve operatively coupled at the mattress body for inflating the mattress body from a folded state to an unfolded state, wherein at the folded state, the mattress body is air-vacuumed via the air valve that the top layer is overlapped on the bottom layer to compress the core mattress support therebetween to minimize a thickness of the mattress body, such that the mattress body is rolled up in a compact size at the folded state, wherein at the unfolded state, the mattress body is inflated via the air valve to uncompress the core mattress support so as to fully expand the mattress body; and a peripheral mattress support disposed at the peripheral portion of the mattress body when the mattress body is in the unfolded state.

In accordance with another aspect of the invention, the present invention comprises a method of manufacturing and packaging a foldable mattress, comprising the following steps.

(A) Form a mattress body which comprises a top layer and a bottom layer, and defines a center portion and a peripheral portion.

(B) Dispose a core mattress disposed between the top layer and the bottom layer within the center portion of the mattress body.

(C) Air-vacuum the mattress body at a folded state that the top layer is overlapped on the bottom layer to compress the core mattress support therebetween to minimize a thickness of the mattress body, such that the mattress body is folded into a compact size for storage and transportation.

(D) Inflate the mattress body from the folded state to an unfolded state for usage, wherein the core mattress support is uncompressed to fully expand the mattress body.

(E) Form a peripheral mattress support at the peripheral portion of the mattress body when the mattress body is in the unfolded state.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
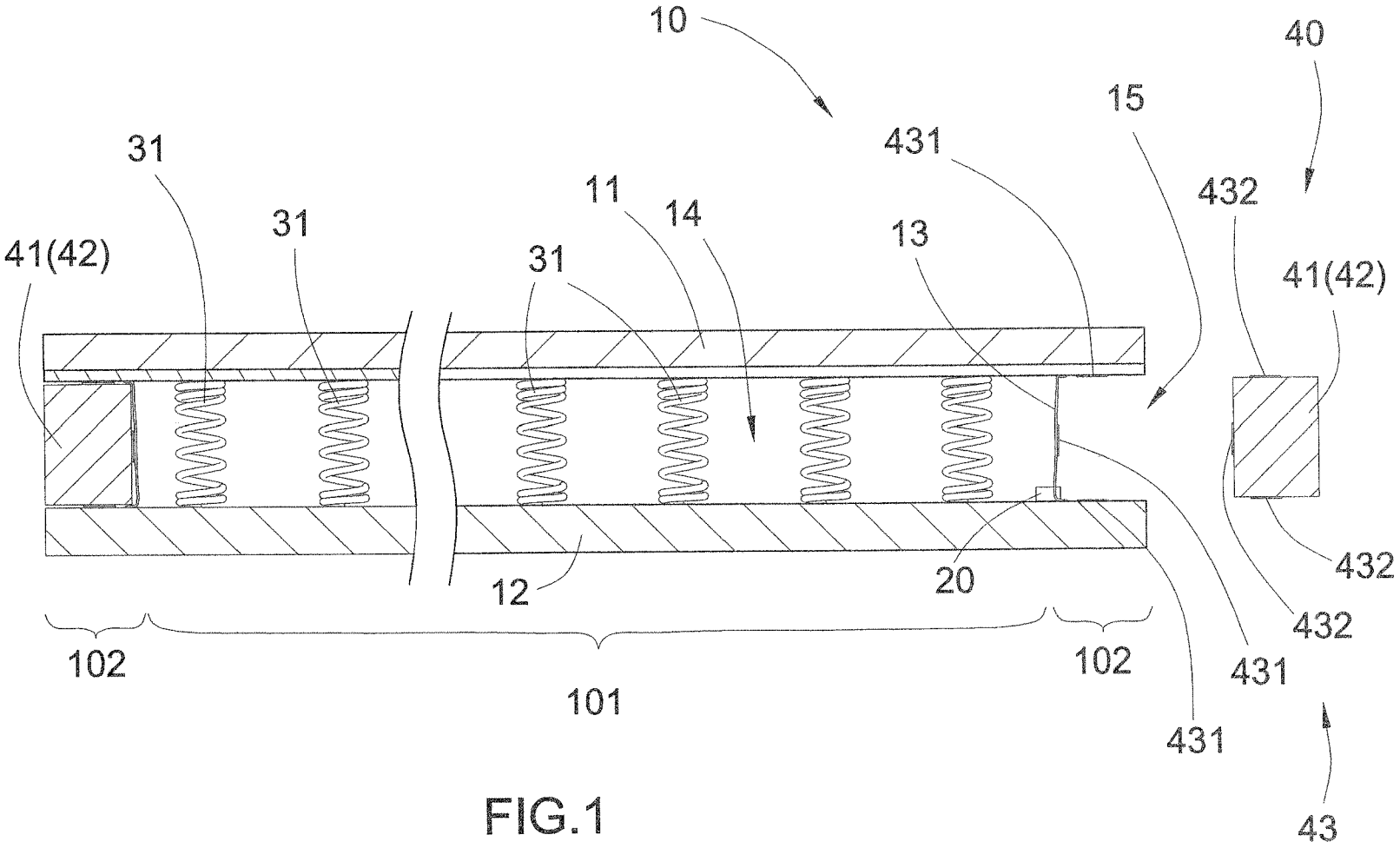
FIG. 1 is a sectional view of a foldable mattress according to a first preferred embodiment of the present invention.
Figure 2:
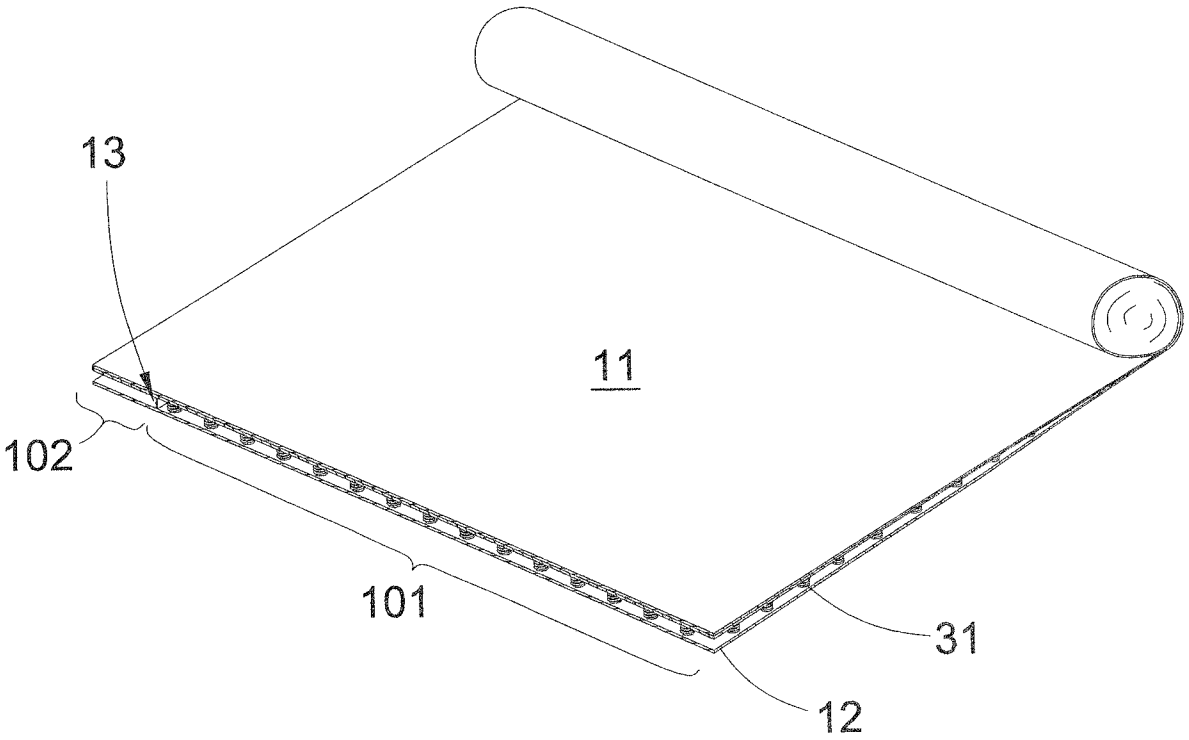
FIG. 2 is a partially sectional view of the foldable mattress according to the above first preferred embodiment of the present invention, illustrating the mattress body being folded and rolled in a folded state.

Referring to FIGS. 1 and 2 of the drawings, a foldable mattress according to a first preferred embodiment of the present invention is illustrated, wherein the foldable mattress comprises a mattress body 10, a support structure, and an air valve 20.

The mattress body 10 comprises a top layer 11, a bottom layer 12, and a side enclosing layer 13 extended between the top layer 11 and the bottom layer 12 to define a mattress cavity 14 within the top layer 11, the bottom layer 12, and the side enclosing layer 13. Accordingly, the top layer 11 and the bottom layer 12 are two mattress covers for a user residing thereon. The material and structure of the top layer 11 can be identical to that of the bottom layer 12. Preferably, the top layer 11 has a cushioning top to provide comfort and soft touch feeling. The mattress body 10 further has a center portion 101 and a peripheral portion 102 encircling around the center portion 101. In other words, the center portion 101 of the mattress body 10 is defined at a center area of each of the top layer 11 and the bottom layer 12. Preferably, the mattress body 10 has a rectangular box shape and defines two longitudinal edges and two transverse edges. Accordingly, the top layer 11, the bottom layer 12, and the side enclosing layer 13 can be compressed to form a sheet-like configuration.

The support structure comprises a core mattress support 30 disposed within the mattress cavity 14 and between the top layer 11 and the bottom layer 12. In particular, the core mattress support 20 is supported within the center portion 101 of the mattress body 10 to provide support a user's weight when the user residues thereon.

According to the first embodiment, the core mattress support 30 comprises a plurality of compressible spring units 31 spacedly retained between the top layer 11 and the bottom layer 12 within the center portion 101 of the mattress body 10. Accordingly, each compressible spring unit 31 are individual enclosed spring units that each unit has its resilient individually, such that each compressible spring unit 31 can flex individually without affecting the adjacent compressible spring units 31 so as to enhance the comfort and support for the user.

The air valve 20 is operatively coupled at the mattress body 10 for communicating the mattress cavity 14 of the mattress body 10 with an exterior thereof. In other words, the air within the mattress cavity 14 of the mattress body 10 can be released out via the air valve 20. The air valve 20 is also arranged for inflating the mattress body 10 from a folded state to an unfolded state.

At the folded state, the mattress body is air-vacuumed via the air valve 20 to suck the air out of the mattress cavity 14 of the mattress body 10. Therefore, the top layer 11 is overlapped on the bottom layer 12 to compress the core mattress support 20 therebetween to minimize a thickness of the mattress body, as shown in FIG. 2, and to form a flat sheet. As a result, the mattress body 10 is rolled up in a compact size at the folded state, which is useful in transportation and storage. At the unfolded state, the mattress body 10 is inflated via the air valve 20 to draw the air into the mattress cavity 14 of the mattress body 10 and to uncompress the core mattress support 30 so as to fully expand the mattress body 10 to its original shape and size.

As shown in FIG. 2, the air valve 20 is a self-inflatable valve operatively coupled at the side enclosing layer 13 of the mattress body 10 to communicate with the mattress cavity 14 thereof. Therefore, when a compressing force of a pressing machine is applied to the mattress body 10, the air within the mattress cavity 14 of the mattress body 10 will be squeezed out via the air valve 20. Obviously, the compressing force is greater than the user's weight and is strong enough to compress each of the entire compressible spring units 31 to minimize the thickness of the mattress body 10, i.e. the distance between the top layer 11 and the bottom layer 12.

Figure 3:
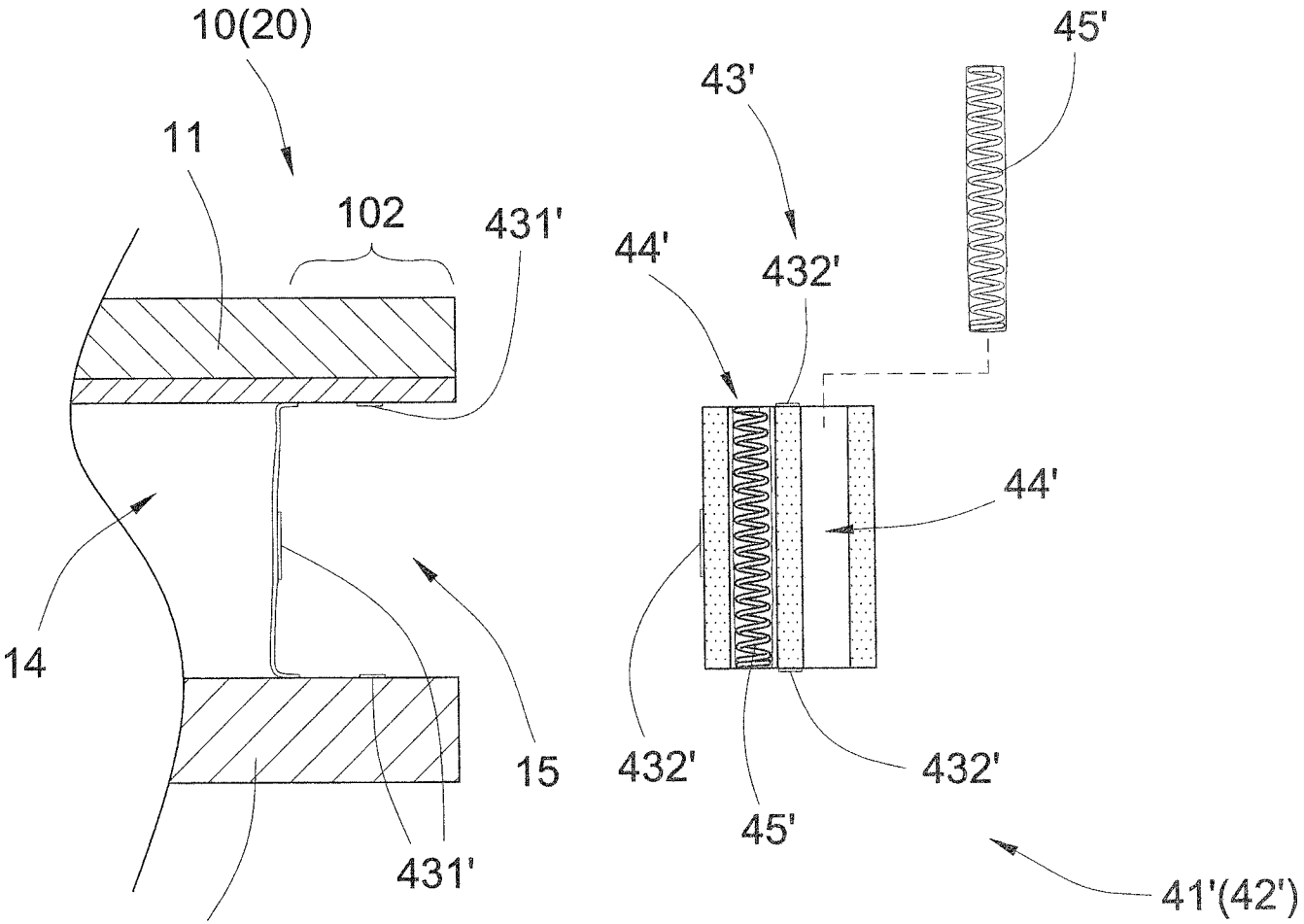
FIG. 3 illustrates an alternative mode of the peripheral mattress support according to the above first preferred embodiment of the present invention.

Preferably, at least one of the top layer 11, the bottom layer 12, and the side enclosing layer 13 is made of air breathable material to allow the air penetrating therethrough. Therefore, the air valve 20 can be integrated with the mattress body 10 that at least one of the top layer 11, the bottom layer 12, and the side enclosing layer 13 can serve as the air valve 20 to release the air from the mattress cavity 14 of the mattress body 10 and to inflate the mattress body 10, as shown in FIG. 3.

As shown in FIG. 1, the support structure further comprises a peripheral mattress support 40 disposed at the peripheral portion 102 of the mattress body 10 when the mattress body 10 is in the unfolded state. According to the first embodiment, the peripheral mattress support 40 is detachably coupled to the mattress body 10 at the peripheral portion 102 thereof when the mattress body 10 is in the unfolded state, and is detached from the mattress body 10 when the mattress body 10 is in the folded state.

As shown in FIG. 1, the mattress body 10 further has a peripheral channel 15 formed along the peripheral portion 101 to detachably receive the peripheral mattress support 40. Accordingly, the peripheral channel 15 is indently formed at peripheral of the mattress body 10. In particular, the side enclosing layer 13 is extended between the top layer 11 and the bottom layer 12 to enclose the core mattress support 30 within an inner side of the side enclosing layer 13, wherein the peripheral channel 15 is formed at an outer side of the side enclosing layer 13 to detachably receive the peripheral mattress support 40. In other words, the peripheral channel 15 is formed within the side enclosing layer 13, the peripheral portion 102 of the first layer 11, and the peripheral portion 102 of the second layer 12.

Figure 7:
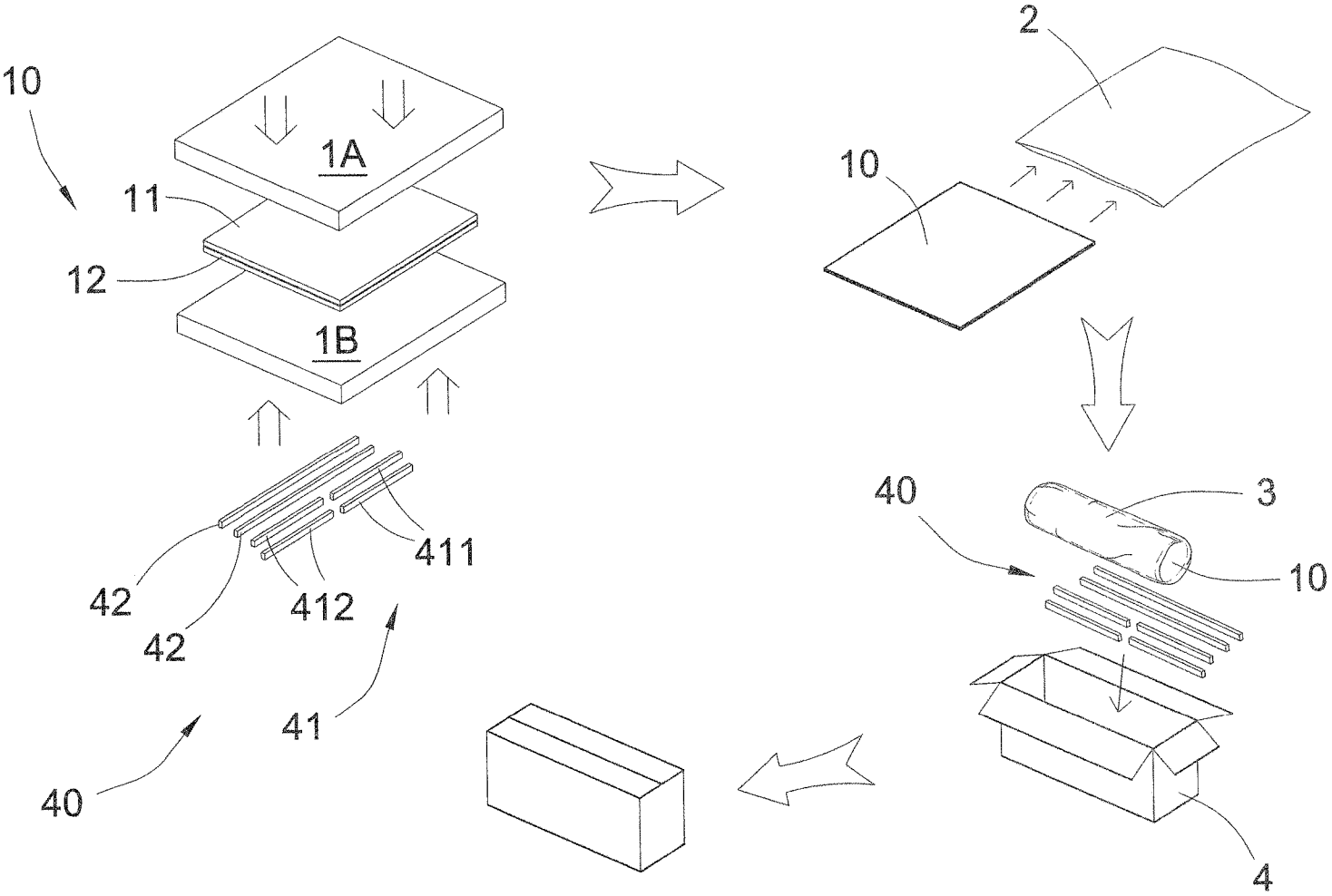
FIG. 7 illustrates a manufacturing and packaging method of the foldable mattress according to the first preferred embodiment of the present invention.

As shown in FIGS. 1, 2, and 7, the peripheral mattress support 40 comprises two longitudinally peripheral support members 41 detachably coupled at two longitudinal sides of the mattress body 10 along the peripheral channel 15 thereat and two transversely peripheral support members 42 detachably coupled at two transverse sides of the mattress body 10 along the peripheral channel 15 thereat. For the rectangular box shaped mattress body 10, the length of each of the longitudinally peripheral support members 41 is longer than the length of each of the transversely peripheral support members 42. Preferably, the longitudinally peripheral support members 41 and the transversely peripheral support members 42 are elongated member and are made of memory foam material to support the peripheral portion 102 of the mattress body 10. The cross section of each of the longitudinally peripheral support members 41 and the transversely peripheral support members 42 matches with the cross section of the peripheral channel 15. Preferably, each of the longitudinally peripheral support members 41 and the transversely peripheral support members 42 has a rectangular cross section.

In order to reduce the length of the longitudinally peripheral support member 41, each longitudinally peripheral support member 41 comprises a first elongated longitudinal member 411 and a second elongated longitudinal member 412 detachably coupled end-to-end. Therefore, the first and second elongated longitudinal members 411, 412 can be detachably received at the peripheral channel 15 end-to-end along the longitudinal side of the mattress body 10 to form the longitudinally peripheral support member 41.

The support structure further comprises a fastening unit 43 for detachably fastening the peripheral mattress support 40 along the peripheral channel 15. Accordingly, the fastening unit 43 comprises a first fastener 431 provided along an inner wall of the peripheral channel 15 and a second fastener 432 provided along the peripheral mattress support 40, such that when the peripheral mattress support 40 is received in the peripheral channel 15, the second fastener 432 is detachably fastened with the first fastener 431 to retain the peripheral mattress support 40 in position. Preferably, the first fastener 431 and the second fastener 432 are hook and loop fasteners, wherein the hook fasteners are spacedly provided along the peripheral channel 15 at the outer side of the side enclosing layer 13, at the bottom side of the top layer 11, and/or the upper side of the bottom layer 12. The loop fasteners are provided along each of the longitudinally peripheral support members 41 and the transversely peripheral support members 42 at the inner side, top side, and/or the bottom side thereof. It is appreciated that the fastening unit 43 can be a button-and-buttonhole structure or tying string to retain the peripheral mattress support 40 along the peripheral channel 15 in position.

Alternatively, each of the longitudinally peripheral support members 41' and the transversely peripheral support members 42' of the peripheral mattress support 40' has a plurality of spring cavities 44', wherein a plurality of peripheral support springs 45' are spacedly coupled within the longitudinally peripheral support members 41' and the transversely peripheral support members 42' at the spring cavities 43 respectively, as shown in FIG. 3. It is appreciated that the peripheral support springs 45' can be built-in with each of the longitudinally peripheral support members 41' and the transversely peripheral support members 42'. Therefore, when the peripheral mattress support 40' is received along the peripheral channel 15 and is retained by the first and second fasteners 431', 432' of the fastening unit 43', the peripheral support springs 45' will support the peripheral portion 102 of the mattress body 10.

Figure 4:
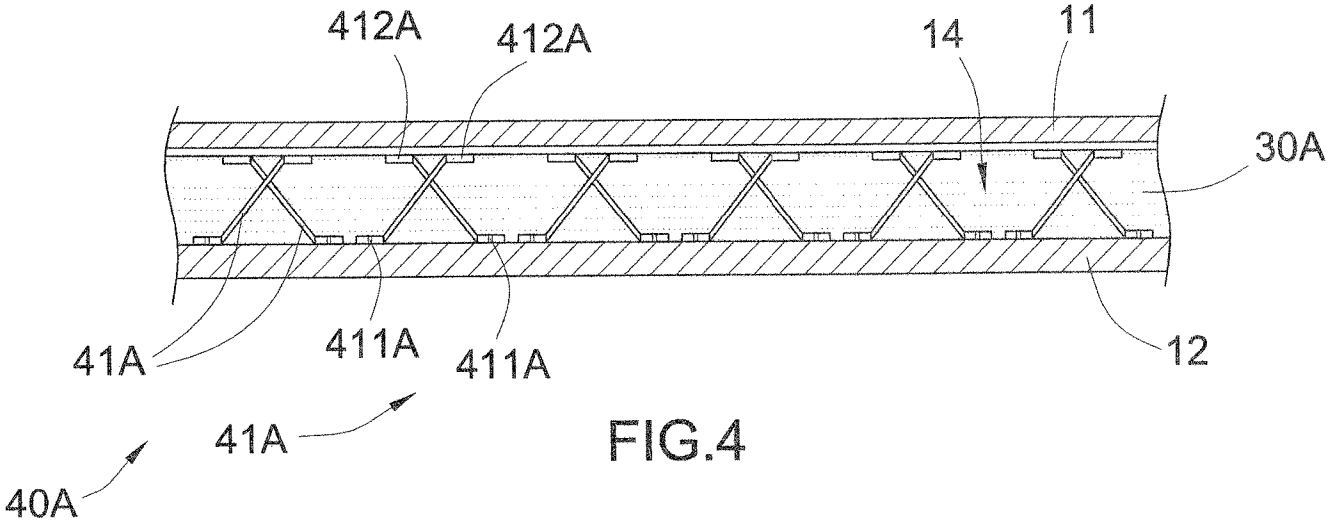
FIG. 4 is a sectional view of a foldable mattress according to a second preferred embodiment of the present invention.
Figure 5:
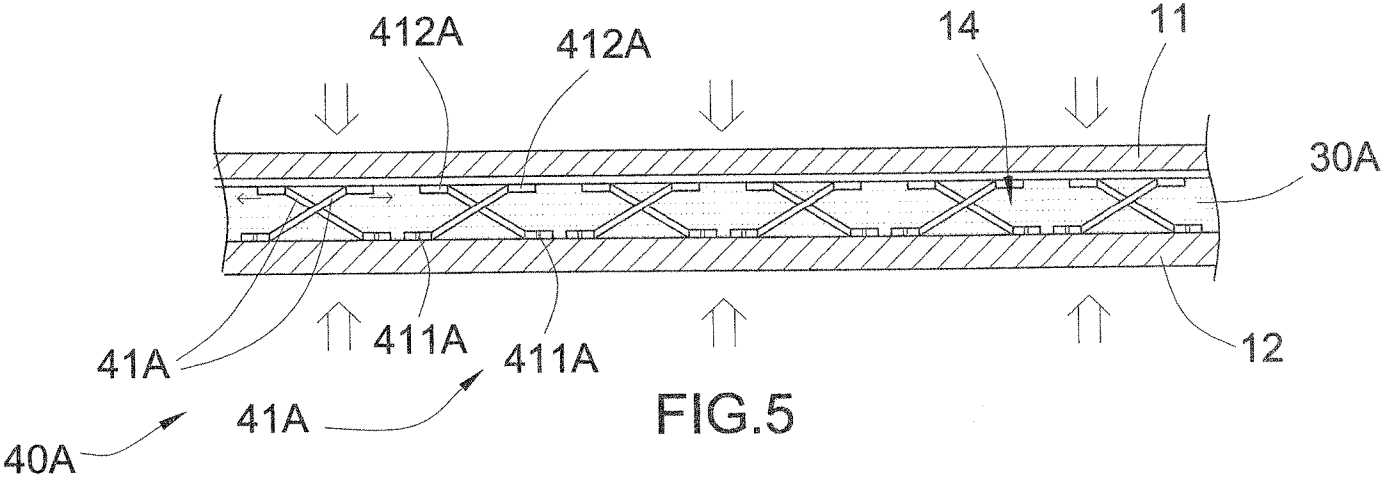
FIG. 5 is a sectional view of the foldable mattress according to the above second preferred embodiment of the present invention, illustrating the resilient elements being compressed from the unfolded state to the folded state.

As shown in FIGS. 4 and 5, a foldable mattress according to a second embodiment illustrates an alternative mode of the first embodiment. In particular, the second embodiment illustrates the alternative mode of the support structure. Accordingly, the first modification of the core mattress support 30A is that the core mattress support 30A comprises a compressible memory foam pad retained between the top layer 11 and the bottom layer 12 within the center portion 101 of the mattress body 10 to provide support a user's weight when the user residues thereon. Accordingly, the memory foam pad of the core mattress support 30A can be compressed to minimize the overall thickness of the mattress body 10 and can be expanded back to its original form to fully expand the mattress body 10.

In addition, the peripheral mattress support 40A comprises a plurality of resilient elements 41A spacedly disposed along the peripheral portion 102 of the mattress body 10, wherein the resilient elements 41A are rigid enough to support the user's weight and are flexible enough to be compressed by the compressing force of the pressing machine. In particular, the resilient elements 41A are built-in within the mattress cavity 14 of the mattress body 10 at the peripheral portion 102 thereof. In other words, the side enclosing layer 13 is affixed to the top layer 11 and the bottom layer 12 edge-to-edge. When the core mattress support 30A is compressed, the resilient elements 41A are also compressed to minimize the thickness of the mattress body 10 at the folded state.

As shown in FIGS. 4 and 5, each of the resilient elements 41A has an affixing end 411A affixed on the bottom layer 12 and a sliding end 412A slidably coupled at the top layer 11, such that when the top layer 11 is pressed to overlap on the bottom layer 12 at the folded state, the sliding ends 412A of the resilient elements 41A are slid at the top layer 11 to compress the resilient elements 41A. It is worth mentioning that each of the resilient elements 41A has a Z-shape to construct a Z-shaped spring. The resilient elements 41A are formed in pair to have a "X" configuration, such that the sliding ends 412A of each pair of the resilient elements 41A are slid toward each other, as shown in FIG. 5. When the resilient elements 41A are compressed, each pair of resilient elements 41A are parallel with each other.

Figure 6:
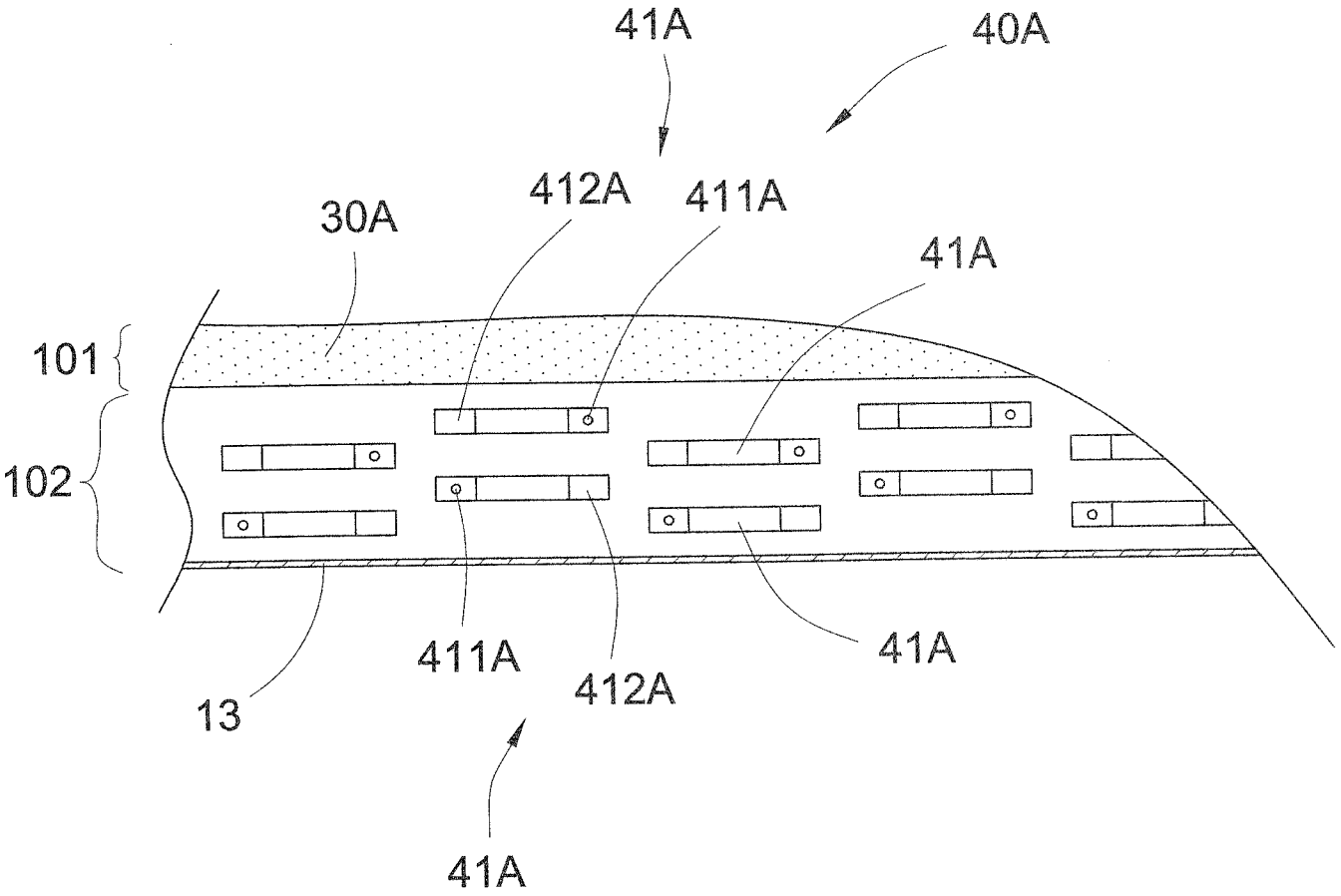
FIG. 6 illustrates the displacement arrangement of the resilient elements along the peripheral portion of the mattress body according to the above second preferred embodiment of the present invention.

Since the sliding ends 412A of the resilient elements 41A are slid at the top layer 11, the resilient elements 41A are aligned along the peripheral portion 102 of the mattress body 10 in an alternating manner to allow sliding displacements of the sliding ends 412A of the resilient elements 41A at the top layer 11, so as to prevent the sliding ends 412A of the resilient elements 41A being hit each other, as shown in FIG. 6.

The present invention further provides a manufacturing and packaging the foldable mattress, as shown in FIG. 7, wherein the method comprises the following steps.

(1) Form the mattress body 10 to form the top layer 11, the bottom layer 12, and the side enclosing layer 13.

(2) Dispose the core mattress support 30, 30A disposed between the top layer 11 and the bottom layer 12 within the center portion 101 of the mattress body 10.

(3) Air-vacuum the mattress body 10 at the folded state that the top layer 11 is overlapped on the bottom layer 12 to compress the core mattress support 30, 30A therebetween to minimize the thickness of the mattress body 10. As shown in FIG. 7, the pressing machine comprises an upper pressing platform 1A and a lower pressing platform 1B, wherein the mattress body 10 is placed between the upper and lower pressing platform 1A, 1B. Therefore, during the operation of the pressing machine, the mattress body 10 is compressed by the upper and lower pressing platform 1A, 1B to release the air out of the mattress cavity 14 of the mattress body 10 via the air valve 20. Once the mattress body 10 is compressed into a sheet form, the compressed mattress body 10 is air-sealed within a sealing bag 2 to retain the compressed mattress body 10 at the folded state. Accordingly, the sealing bag 2 is strong enough to prevent the expansion of the compressed mattress body 10. Then, the compressed mattress body 10 can be rolled up into a roll form and the rolled mattress body 10 can be sealed in second sealing bag 3 to retain the mattress body 10 in a roll form. The rolled mattress body 10 can be packed in a box 4 for storage and transportation.

(4) Inflate the mattress body 10 from the folded state to the unfolded state for usage, wherein the core mattress support 30 is uncompressed to fully expand the mattress body 10. After the user receives the rolled mattress body 10 packed inside the box 4, the user is able to remove the second sealing bag 3 to unroll the mattress body 10. Then, by removing the sealing bag 2, the mattress body 10 is automatically inflated via the air valve 20 from the folded state to the unfolded state.

(5) Form the peripheral mattress support 40, 40A at the peripheral portion 102 of the mattress body 10 when the mattress body 10 is in the unfolded state.

According to the first embodiment, the longitudinally peripheral support members 41 and the transversely peripheral support members 42 can be also packed in the box 4. Therefore, once the mattress body 10 is fully expanded at the unfolded state, the longitudinally peripheral support members 41 and the transversely peripheral support members 42 can be received along the peripheral channel 15 of the mattress body 10, such that the center portion 101 of the mattress body 10 is supported by the mattress core support 30 while the peripheral 102 of the mattress body 10 is supported by the peripheral mattress support 40.

In view of the second embodiment, the resilient elements 41A are compressed at the same time when the mattress core support 30A is compressed. Therefore, the compressed mattress body 10 can be rolled with the compressed resilient elements 41 to form the rolled mattress body 10. It is worth mentioning that once the mattress body 10 is fully expanded at the unfolded state, the resilient elements 41A will returns back to the original form to support the peripheral 102 of the mattress body 10.

It is worth mentioning that the mattress core support 30, 30A of the first and second embodiments are interchangeable, such that the mattress core support 30 with the spring-loaded feature can incorporate with the resilient elements 41A of the peripheral mattress support 40A while the mattress core support 30A with the memory foam feature can incorporate with the detachable feature of the peripheral mattress support 40.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A foldable mattress, comprising:

a mattress body which has a center portion and a peripheral portion, wherein said mattress body comprises a top layer, a bottom layer, and a side enclosing layer extended between said top layer and said bottom layer, wherein said mattress body further has a mattress cavity formed at said center portion thereof and enclosed within said top layer, said bottom layer, and an inner side of said side enclosing layer, wherein said mattress body further has a peripheral channel formed at said peripheral portion thereof and defined within said top layer, said bottom layer, and an outer side of said side enclosing layer;

an air valve operatively coupled at said mattress body for inflating said mattress body from a folded state to an unfolded state, wherein at said folded state, said mattress body is deflated that said top layer is overlapped on said bottom layer, wherein at said unfolded state, said mattress cavity is inflated at said center portion of said mattress body; and a peripheral mattress detachably received at said peripheral channel between said top layer and said bottom layer of said mattress body to support said peripheral portion thereof when said mattress body is at said unfolded state, wherein said peripheral mattress is removed from said peripheral channel to detach from said mattress body when said mattress body is at said folded state.

2. The foldable mattress, as recited in claim 1, further comprising a first fastener provided at said outer side of said side enclosing layer and a second fastener provided at said peripheral matter, wherein said first fastener and said second fastener are fastened with each other when said peripheral mattress is received at said peripheral channel to retain said peripheral mattress at said peripheral portion of said mattress body.

3. The foldable mattress, as recited in claim 1, further comprising a core mattress support disposed within said mattress cavity and between said top layer and said bottom layer within said center portion of said mattress body.

4. The foldable mattress, as recited in claim 2, further comprising a core mattress support disposed within said mattress cavity and between said top layer and said bottom layer within said center portion of said mattress body.

5. The foldable mattress, as recited in claim 3, wherein said core mattress support comprises a plurality of compressible spring units spacedly retained between said top layer and said bottom layer within said center portion of said mattress body.

6. The foldable mattress, as recited in claim 4, wherein said core mattress support comprises a plurality of compressible spring units spacedly retained between said top layer and said bottom layer within said center portion of said mattress body.

7. The foldable mattress, as recited in claim 1, wherein said peripheral mattress is made of memory foam material.

8. The foldable mattress, as recited in claim 6, wherein said peripheral mattress is made of memory foam material.

9. The foldable mattress, as recited in claim 1, wherein said air valve is a self-inflatable valve, such that mattress body is self-inflated when said air valve is opened.

10. The foldable mattress, as recited in claim 8, wherein said air valve is a self-inflatable valve, such that mattress body is self-inflated when said air valve is opened.

11. A method of manufacturing a foldable mattress, comprising the steps of:

(a) forming a mattress body which has a center portion and a peripheral portion, wherein said mattress body comprises a top layer, a bottom layer, and a side enclosing layer extended between said top layer and said bottom layer, wherein said mattress body further has a mattress cavity formed at said center portion thereof and enclosed within said top layer, said bottom layer, and an inner side of said side enclosing layer, wherein said mattress body further has a peripheral channel formed at said peripheral portion thereof and defined within said top layer, said bottom layer, and an outer side of said side enclosing layer;

(b) disposing a core mattress support disposed within said mattress cavity and between said top layer and said bottom layer within said center portion of said mattress body;

(c) coupling an air valve at said mattress body for inflating said mattress body from a folded state to an unfolded state, wherein at said folded state, said mattress body is deflated that said top layer is overlapped on said bottom layer, wherein at said unfolded state, said mattress cavity is inflated at said center portion of said mattress body; and (d) detachably receiving a peripheral mattress at said peripheral channel between said top layer and said bottom layer of said mattress body to support said peripheral portion thereof when said mattress body is at said unfolded state, wherein said peripheral mattress is removed from said peripheral channel to detach from said mattress body when said mattress body is at said folded state.

12. The method, as recited in claim 11, further comprising the steps of:

(e) providing a first fastener at said outer side of said side enclosing layer; and (f) providing a second fastener at said peripheral matter, wherein said first fastener and said second fastener are fastened with each other when said peripheral mattress is received at said peripheral channel to retain said peripheral mattress at said peripheral portion of said mattress body.

13. The method, as recited in claim 12, wherein said air valve is a self-inflatable valve coupled at said mattress body to deflate said mattress body and to self-inflate said mattress body.

14. The method, as recited in claim 12, when said mattress body is deflated at said folded state, further comprising a step of air-sealing said mattress body at said folded state within a sealing bag to retain said mattress body at said folded state, such that when said mattress body is removed from said sealing bag, said mattress body is automatically inflated from said folded state to said unfolded state.

15. The method, as recited in claim 12, wherein in said step (c), said mattress body at said folded state is rolled up in said compact size.

16. The method, as recited in claim 12, wherein said core mattress support comprises a plurality of compressible spring units spacedly retained between said top layer and said bottom layer within said center portion of said mattress body.

17. The method, as recited in claim 12, wherein said peripheral mattress is made of memory foam material.

* * * * *